US010328607B2

(12) United States Patent
Toncelli

(10) Patent No.: US 10,328,607 B2
(45) Date of Patent: Jun. 25, 2019

(54) MACHINE FOR CUTTING STONE MATERIAL

(71) Applicant: Luca Toncelli, Bassano del Grappa (IT)

(72) Inventor: Luca Toncelli, Bassano del Grappa (IT)

( * ) Notice: Subject to any disclaimer, the term of this patent is extended or adjusted under 35 U.S.C. 154(b) by 45 days.

(21) Appl. No.: 15/520,105

(22) PCT Filed: Nov. 3, 2015

(86) PCT No.: PCT/IB2015/058494

§ 371 (c)(1),
(2) Date: Apr. 19, 2017

(87) PCT Pub. No.: WO2016/071838

PCT Pub. Date: May 12, 2016

(65) Prior Publication Data

US 2017/0305035 A1 Oct. 26, 2017

(30) Foreign Application Priority Data

Nov. 3, 2014 (IT) ..... TV2014A0154
Apr. 2, 2015 (IT) ..... 20201510860

(51) Int. Cl.
*B28D 7/04* (2006.01)
*B28D 1/04* (2006.01)
*B28D 1/06* (2006.01)

(52) U.S. Cl.
CPC ..... *B28D 7/046* (2013.01); *B28D 1/04* (2013.01); *B28D 1/043* (2013.01); *B28D 1/044* (2013.01);
(Continued)

(58) Field of Classification Search
CPC ..... B28D 1/04; B28D 1/042; B28D 1/043; B28D 1/044; B28D 1/046; B28D 1/047;
(Continued)

(56) References Cited

U.S. PATENT DOCUMENTS 2,657,680 A * 11/1953 Evans ..... B23D 47/04 125/14
3,747,457 A * 7/1973 Thompson ..... B27B 7/02 83/471.2

(Continued)

FOREIGN PATENT DOCUMENTS

CN 203460321 U 3/2014
IT 1402232 B1 8/2013

(Continued)

OTHER PUBLICATIONS

English translation: claims for Italian Publication No. 1402232 B1, published Aug. 28, 2013, 3 pgs.

(Continued)

*Primary Examiner* — Eileen P Morgan
(74) *Attorney, Agent, or Firm* — Fredrikson & Byron, P.A.

(57) ABSTRACT

A machine (12) for cutting slabs, comprises a workpiece support bench (14) adapted to support at least one slab, and cutting means for automated cutting of the slab on the bench. The cutting means comprise two lateral support structures (16, 18). A first beam (20) is adapted to move along said lateral support structures (16, 18). The first beam (20) is adapted to slide on the lateral support structures (16, 18) via its ends (22, 24) and guiding means (25, 26) provided on the lateral support structures (16, 18). The first beam (20) is provided with a first carriage (28) adapted to be moved along the first beam (20). A first sleeve (30) adapted to be moved towards or away from the workpiece support bench (14) is provided on the first carriage (28). A first machining head (32) comprising a first cutting spindle (34) is provided on the first sleeve (30). A second beam (201) is adapted to move along the lateral support structures (16, 18). The second beam (201) is adapted to slide on the lateral support structures (16, 18) via its ends (221, 241) and guiding means (26)

(Continued)

provided on the lateral support structures (16, 18), independently of the first beam (20). The second beam (201) is provided with a second carriage (281) which is adapted to be moved along the second beam (201). A second sleeve (301) adapted to be moved towards or away from the workpiece support bench (14) is provided on the second carriage (281). A second machining head (321) comprising a second cutting spindle (341) is provided on the second sleeve (301). At least either one of the first head (32) and the second head (321) is provided with a gripping device (42, 421) for the slabs or parts thereof.

15 Claims, 10 Drawing Sheets

(52) U.S. Cl.
CPC ..... *B28D 1/047* (2013.01); *B28D 1/048* (2013.01); *B28D 1/068* (2013.01); *B28D 7/04* (2013.01)

(58) Field of Classification Search
CPC ..... B28D 1/048; B28D 1/068; B28D 7/04; B28D 7/046
USPC ..... 125/35
See application file for complete search history.

(56) References Cited

U.S. PATENT DOCUMENTS 4,584,918 A * 4/1986 Stubbe ..... B27B 5/207 83/471.3
5,921,228 A * 7/1999 Watson ..... B28D 1/043 125/13.01
6,006,735 A * 12/1999 Schlough ..... B24B 9/06 125/13.01
6,131,557 A * 10/2000 Watson ..... B23D 59/001 125/13.01
6,222,155 B1 * 4/2001 Blackmon ..... B23K 7/002 219/121.39
7,748,373 B2 * 7/2010 Toncelli ..... B28D 1/043 125/35
9,886,019 B2 * 2/2018 Toncelli ..... G05B 19/18
2005/0288161 A1 * 12/2005 Toncelli ..... B23C 1/002 483/31
2006/0084364 A1 * 4/2006 Toncelli ..... B28D 1/003 451/5
2008/0110311 A1 * 5/2008 Stangherlin ..... B26F 1/3813 83/177
2010/0258102 A1 * 10/2010 Jacobsson ..... B23D 45/027 125/4
2013/0025422 A1 * 1/2013 Chillman ..... B24C 1/045 83/53
2016/0207224 A1 * 7/2016 Toncelli ..... B28D 7/046

FOREIGN PATENT DOCUMENTS

WO 2011039700 A1 4/2011
WO 2011145005 A1 11/2011
WO 2014140946 A1 9/2014

OTHER PUBLICATIONS

PCT International Search Report and Written Opinion dated Feb. 15, 2016 for Intl. App. No. PCT/IB2015/058494, from which the instant application is based, 9 pgs.

* cited by examiner

MACHINE FOR CUTTING STONE MATERIAL

RELATED APPLICATIONS

This application is a 35 U.S.C. 371 national stage filing from International Application No. PCT/IB2015/058494, filed Nov. 3, 2015, which claims priority to Italian Application No. 202015000010860, filed Apr. 2, 2015 and Italian Application No. TV2014A000154, filed Nov. 3, 2014, the teachings of which are incorporated herein by reference.

The present invention relates to a machine for cutting stone material.

In particular, the present invention relates to a machine for cutting natural stone, agglomerate, ceramic or glass material.

In the continuation of the present description reference will be made to the cutting of slabs of natural stone and agglomerate, ceramic and glass material, without however this being intended to limit the possible materials which may be machined. The machining of other materials may also be carried out by a machine designed in accordance with the principles of the present invention.

The machines which are preferably used for this type of machining comprise a machining head which is moved above a workpiece support bench. The means used to move the machining head may comprise various alternatives, but among these the most common solution comprises two lateral support structures on which a beam is arranged transversely with respect thereto.

The beam is adapted to slide on the lateral support structures via guiding means provided on the lateral support structures and on the ends of the beam.

A sleeve-holder carriage is arranged on the beam and is adapted to slide along the beam in a transverse direction with respect to the lateral support structures.

A sleeve is provided on the sleeve-holder carriage and may be moved relative to the sleeve-holder carriage in a vertical direction towards or away from the workpiece support bench.

The end of the sleeve is provided with a machining head having a spindle on which a cutting disk is mounted.

The workpiece support bench and/or the spindle are adapted to rotate about respective vertical axes so as to be able to adjust in any direction the cutting disk with respect to the slab to be cut.

The cutting disks used are of the diamond type and are provided with a protection element for the operator, mounted on the cutting spindle. The element provides on the one hand protection against possible detachment of diamond segments from the disk. Furthermore, it is also adapted to contain and retain any spray of the cooling fluid used during cutting of the slab and containing machining residue.

It is also known to provide devices for moving the slabs, or parts of a slab obtained therefrom, above the workpiece support bench. These devices may be of a different type and have different forms.

The devices which have been found to be most advantageous comprise sucker means provided on the head or on the protection element.

In a particular configuration, these sucker means are provided on the external surface of the protection element, with an operating surface which lies substantially parallel to the plane in which the cutting disk lies. In other words, the gripping surface of the sucker means is substantially parallel to the cutting direction.

In these machines, after performing the cut, and when it is required to move a slab or part thereof, the spindle is rotated through approximately 90° about an axis which is substantially parallel to the plane in which the workpiece support bench lies, and in such a way that the operating surface of the sucker means is substantially parallel to the surface of the slab to be moved.

The sucker means, whether they be attached to the head or to the protection element, are moved closer by means of a vertical movement of the sleeve until they come into contact with the slab to be moved.

At this point a vacuum circuit, which is connected to the interior of the sucker means, is activated and in this way gripping between the sucker means and the workpiece is ensured.

The workpiece may then be moved away from the other workpieces being machined so that for example a successive machining operation may be completed.

Once displacement has been completed, the workpiece is released and the sucker means may be used to move another slab part or a slab, or, by means of a rotation in a direction opposite to that of the preceding rotation, the spindle is repositioned so that the cutting disk assumes again a position substantially perpendicular to the workpiece support bench.

The rotation about a horizontal axis (parallel to the plane in which the workpiece support bench lies) may be used also to perform cuts inclined in a manner known per se to the person skilled in the art.

The slab may also be cut according to different patterns, for example a chequer-board pattern, or according to more complex patterns if the machine is equipped with means for moving the pieces of cut material.

Machines having the aforementioned characteristics are described for example in Italian patent application TV2009A000189, in international patent application WO2011/145005 and in Italian patent 1402232.

The machines of the prior art, although widely used and popular, are not without drawbacks.

In fact, for example the productive capacity of this type of machine, although significant, is however limited.

The prior art has attempted to solve these drawbacks in various ways, for example by installing two machines, but this means doubling the costs to be incurred. If it is also considered that each machine is often associated with a system for loading slabs and unloading the finished articles so as to form an actual production line, the cost needed to duplicate such a line reaches a very high and on occasions unacceptable figure.

Moreover it must also be considered that the additional space required to install the second machine or rather the second line may occupy a large area of the production plant. It could also happen that there is not sufficient space and therefore it becomes impossible to acquire a second machine/line, thus ruling out the possibility of increasing the production capacity.

The object of the invention is therefore to solve at least partially the drawbacks of the prior art.

A first task of the present invention is to provide a machine which is able to obtain the advantages which could be achieved with the installation of a second machine.

A second task of the present invention is to increase substantially the production capacity of a machine of the type described above, but at the same time without increasing the costs significantly thereof.

A further task of the present invention is to provide a machine which is able to increase the production, while maintaining substantially unchanged the space occupied by the machine inside the production plant.

The object and tasks are achieved with a machine according to claim 1.

In particular the proposed solution is that of providing a machine for cutting slabs, comprising a workpiece support bench adapted to support at least one slab, two lateral support structures and a first beam adapted to move along the lateral support structures. The first beam is adapted to slide on the lateral support structures via its ends and guiding means provided on the lateral support structures. The first beam is provided with a first carriage which is adapted to be moved along the first beam. A first sleeve adapted to be moved towards or away from the workpiece support bench is provided on the first carriage. A first machining head comprising a first cutting spindle is provided on the first sleeve. The machine is characterized in that it comprises a second beam adapted to move along the lateral support structures. The second beam is adapted to slide on the lateral support structures via its ends and guiding means provided on the lateral support structures. The second beam is provided with a second carriage which is adapted to be moved along the second beam. A second sleeve adapted to be moved towards or away from the workpiece support bench is provided on the second carriage. A second machining head comprising a second cutting spindle is provided on the second sleeve. The machine is also characterized in that at least either one of the first head and the second head is provided with a gripping device for the slabs or parts thereof.

The gripping device may be provided directly on the head or provided on the disk protection element.

The cutting disks are adapted to work simultaneously on the slab, in order to reduce to a minimum the machining time.

The characteristic features and advantages of a machine according to the present invention will become clearer from the description below of possible embodiments, provided solely by way of a non-limiting explanation, with reference to the accompanying drawings, in which.

Figure 1:
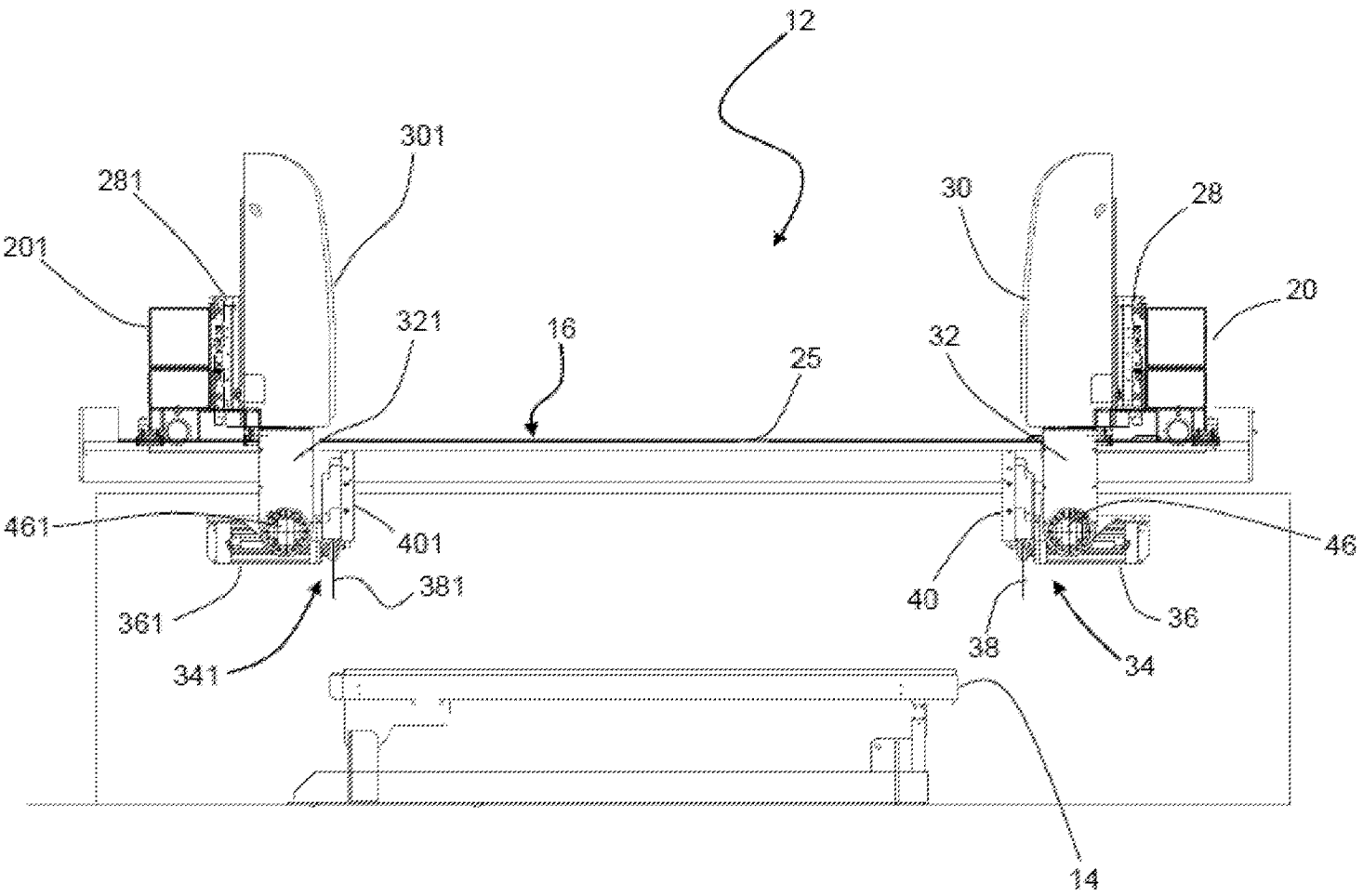
FIG. 1 shows in schematic form a side view of a machine according to the present invention in a possible working configuration.

In FIG. 1 the reference number 12 denotes a machine for cutting slabs according to the present invention.

The machine 12 comprises a workpiece support bench 14 adapted to support at least one slab, and cutting means for automated cutting of slabs.

The cutting means comprise two lateral support structures 16, 18 and a first beam 20 adapted to move along said lateral support structures 16, 18.

The workpiece support bench 14 may be fixed or rotating. In the case where the workpiece support bench 14 is rotating, it is adapted to orient in different directions a slab being machined.

Figure 2:
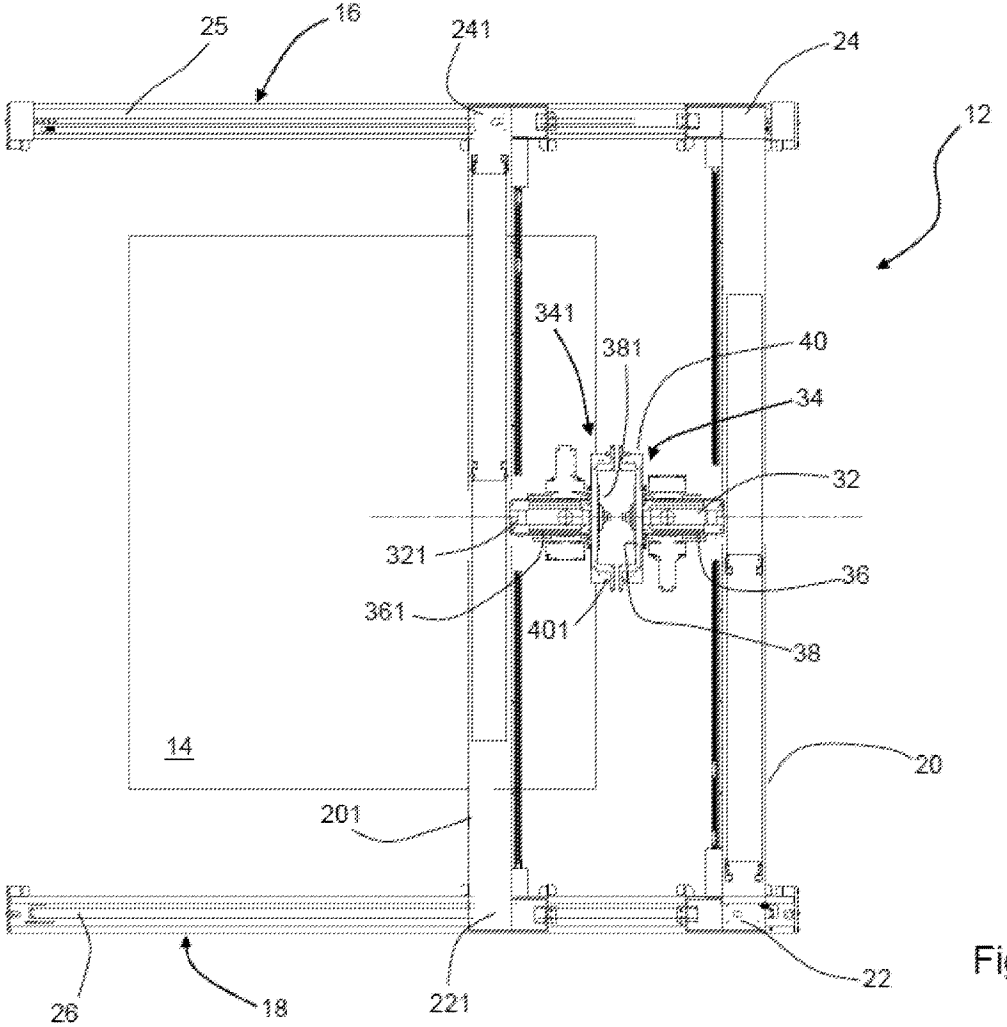
FIG. 2 shows a top plan view of the machine according to FIG. 1, in a different working configuration.

With reference for example to the embodiments of the present invention shown in FIGS. 1 and 2, the lateral support structures 16, 18 may be side walls.

In accordance with an alternative embodiment of the present invention, the lateral support structures 16, 18 may be structures obtained by means of beams.

In both cases the lateral support structures 16, 18 must allow sliding of at least one beam 20 on top of them and in a position situated over the workpiece support bench.

As can be seen in FIGS. 1 and 2, the first beam 20 is adapted to slide on the lateral support structures 16, 18 via its ends 22, 24 and guiding means 25, 26 provided on the lateral support structures 16, 18, respectively.

In this connection the ends 22, 24 may be provided with travel wheels (not shown) which are moved by a suitable drive unit (not shown). The guiding means 25, 26 may be for example guides or guiding profiles on which the travel wheels may run.

In accordance with an alternative embodiment, the ends 22, 24 may be provided with idle travel wheels, adapted to run along guiding means comprising for example guiding profiles, and the beam may be driven by means of a rack-pinion device or a screw/worm device. Advantageously, the screw may have an extension substantially parallel to one or both the lateral support structures 16, 18.

A first carriage 28, adapted to be moved along the first beam 20, is provided on the first beam 20. Since the movement of the first carriage 28 may per se be easily imagined by the person skilled in the art, it will not be further described.

A first sleeve 30 adapted to be moved towards or away from the workpiece support bench 14 is provided on the first carriage 28.

The first sleeve 30 is provided with a first machining head 32 comprising a first cutting spindle 34.

Advantageously, the first spindle 34 is provided with a first electric motor 36 for rotation of a first diamond disk 38.

Since the diamond disk is an element known per se to the person skilled in the art it will not be further described.

The cutting means further comprise a second beam 201 adapted to move along said lateral support structures 16, 18.

The second beam 201 is adapted to slide on the lateral support structures 16, 18 via its ends 221, 241 and guiding means 26 provided on the lateral support structures 16, 18. Advantageously, the second beam 201 uses the same lateral structures and the associated guides along which the two ends of the first beam 20 travel.

Advantageously, the movement of the first beam 20 is independent of the movement of the second beam 201. In other words, each beam 20, 201 is provided with its own movement means.

The ends 221 and 241 of the second beam 201 may be of the same type as the ends 22 and 24 of the first beam.

Advantageously the first beam 20 may be parallel to the second beam 201.

A second carriage 281 is provided on the second beam 201 and is adapted to be moved along the second beam 201.

A second sleeve 301 is provided on the second carriage 281 and is adapted to be moved towards or away from the workpiece support bench 14.

A second machining head 321 comprising a second cutting spindle 341 is provided on the second sleeve 301.

Advantageously, the second spindle 341 is provided with a second electric motor 361 for rotation of a second diamond disk 381.

In accordance with a possible embodiment of the present invention, at least either one of the first cutting spindle 34 and second cutting spindle 341 is provided with a protection element 40, 401.

In accordance with the preferred embodiment of the present invention, shown in the attached figures, both cutting spindles 34, 341 are provided with a common protection element 40, 401.

The machining heads 32, 321 may comprise means for rotation of the cutting spindles 34, 341 about an axis substantially parallel to the plane in which the workpiece support bench lies. The axis of rotation is visible in FIG. 1 and also in FIG. 5 and is indicated by the reference number 46, 461. In this particular embodiment of the present invention it is therefore possible to perform cuts inclined with respect to a direction substantially perpendicular to the plane in which the workpiece support bench lies.

The present invention envisages that at least either one of the first head 32 and the second head 321 is provided with a gripping device 42, 421 provided directly on the head or provided on the disk protection element.

Advantageously, both the heads 32, 321 may comprise a gripping device 42, 421.

In accordance with a possible embodiment of the present invention the gripping device 42, 421 may be of the sucker type.

Figure 3:
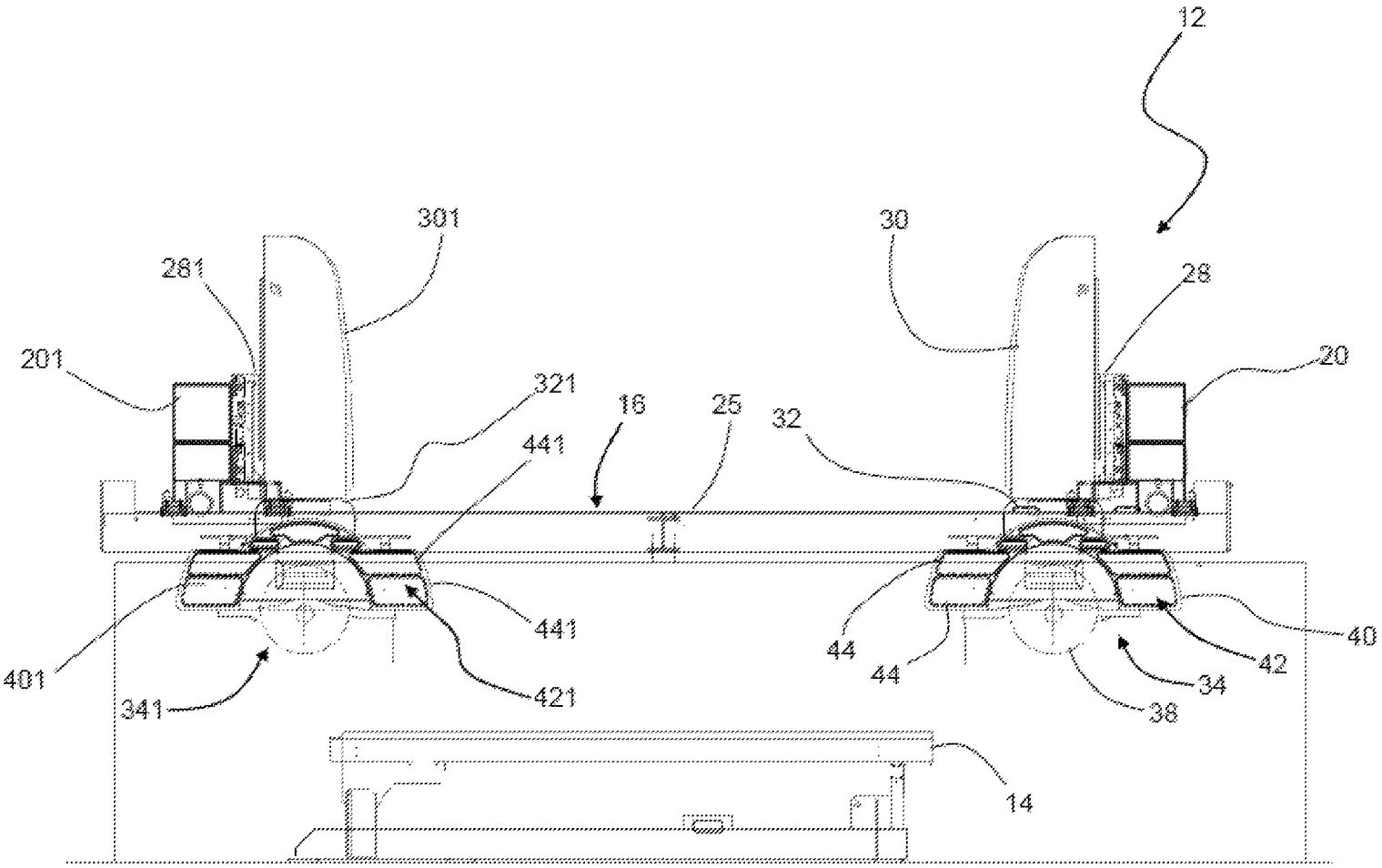
FIG. 3 shows in schematic form a side view of a machine according to the present invention, in a particular working configuration.

With reference to the particular embodiment shown in FIG. 3, at least one of the protection elements 40, 401 comprises a gripping device 42, 421 for moving the slabs.

Advantageously, both the protection elements 40, 401 may comprise a gripping device 42, 421.

In accordance with a possible embodiment of the present invention the gripping device 42, 421 may be of the sucker type. The gripping device 42, 421 may comprise at least one closed sucker element 44, 441 adapted to rest on a slab and prevent in the contact condition fluid from flowing between the internal area and the external area.

A fluid connection with vacuum generating means (not shown) is provided in said internal area of the sucker element 44, 441.

In accordance with a possible embodiment of the present invention each sucker element 44, 441 may be activated in an independent manner.

The two beams 20, 201 and the two cutting spindles 34, 341 may be similar and one or both the cutting spindles 34, 341 may be provided with suckers for moving the parts.

According to an embodiment of the present invention at least one of the sucker elements is moved closer owing to a vertical movement of the sleeve until the sucker means come into contact with the slab to be moved. At this point the vacuum generating means, which are connected to the interior of the sucker means, are activated and in this way gripping between the sucker element and the workpiece is ensured.

The workpiece may then be for example raised from the workpiece support bench 14, moved away from other workpieces being machined and then placed again on the workpiece support bench so that for example a successive machining operation may be completed.

In this embodiment of the machine 12 according to the present invention, in which the sucker means are fixed to the disk protection element, after performing the cut and when it is required to move a slab or a part thereof, the spindle 34, 341 is rotated through approximately 90° about an axis 46, 461 substantially parallel to the plane in which the slab support bench lies of approximately 90° so that the operating surface of the sucker elements is substantially parallel to the surface of the slab to be moved.

Once displacement of the part has been terminated, by means of a rotation in the opposite direction to the preceding direction, the spindle is repositioned so that the diamond disk is arranged again in a position substantially perpendicular to the workpiece support bench.

As regards further details relating to protection elements provided with sucker elements, reference may be made to international patent application WO 2011/145005.

Figure 6:
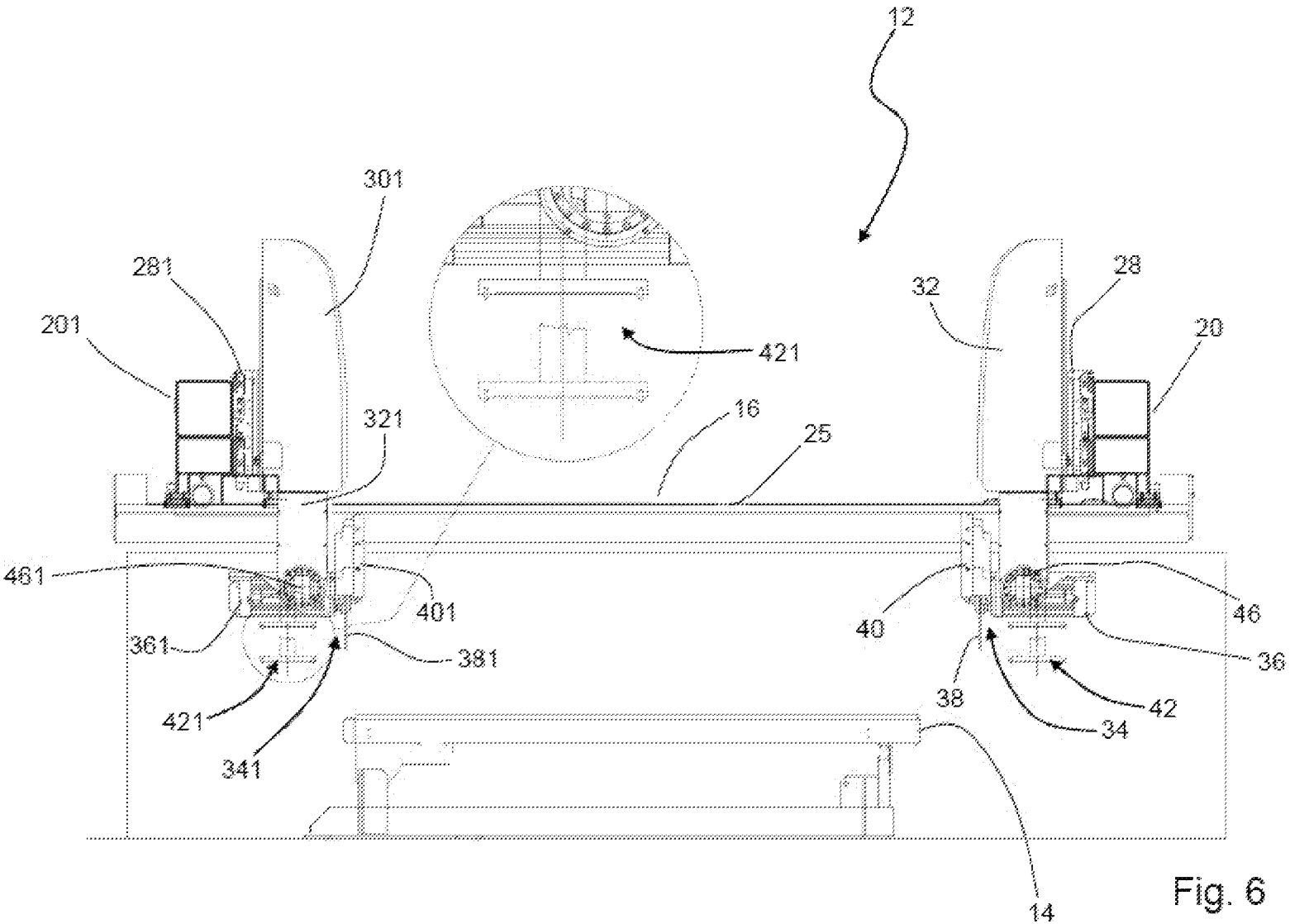
FIGS. 6 and 7 show in schematic form two alternative embodiments of the present invention.

FIG. 6 shows an alternative embodiment of the gripping devices 42, 421. The gripping device 42, 421 is provided directly on the machining head 32, 321 and is slidable in a vertical direction, towards or away from the workpiece support bench 14. Advantageously in this case also, the gripping device may be of the sucker type.

The enlarged view of FIG. 6 shows in continuous lines the rest configuration and in broken lines the working configuration where the gripping device is situated underneath the bottom edge of the disk.

Figure 7:
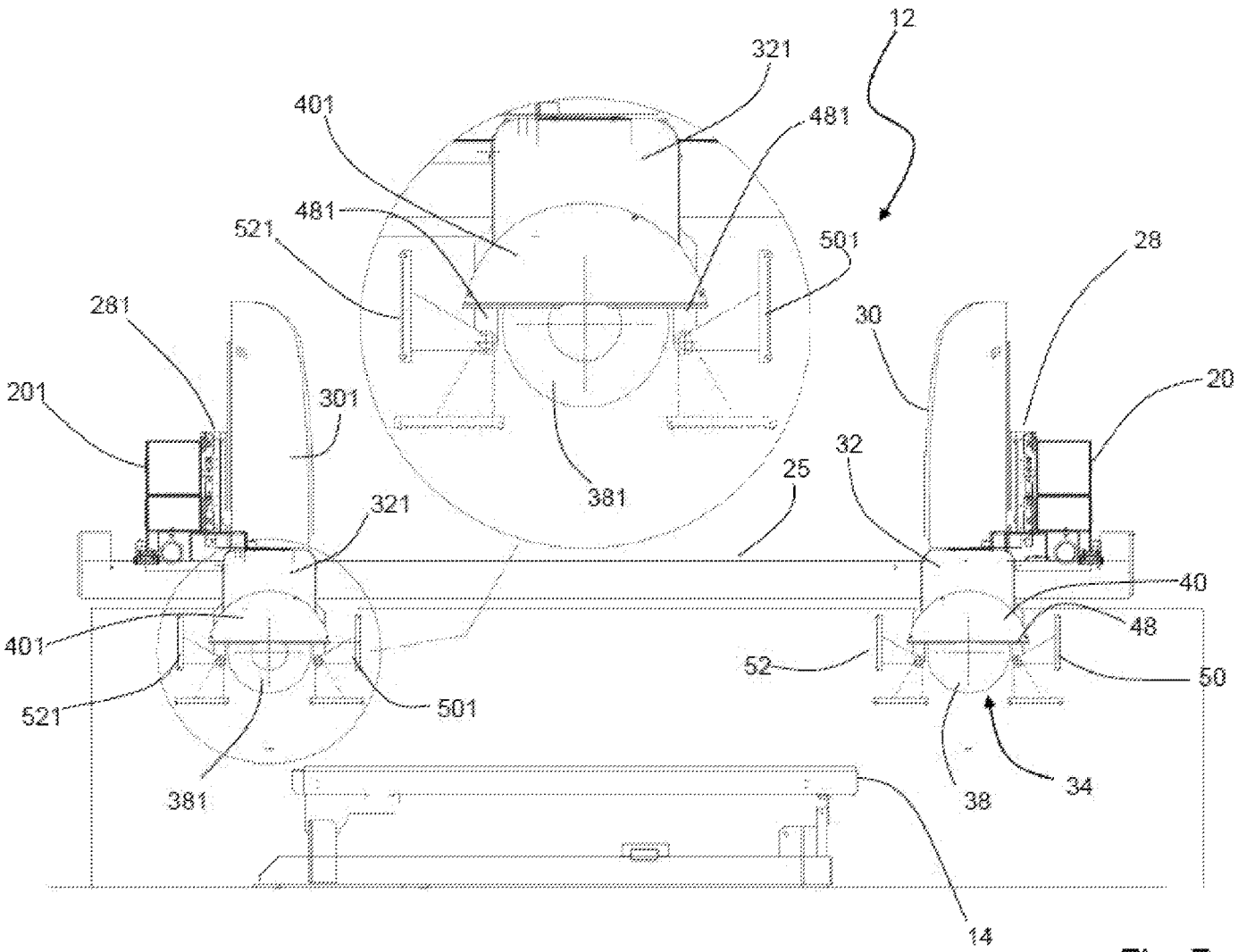

FIG. 7 shows a further embodiment of the gripping device according to the present invention. In this case also the gripping device is arranged on the working head 32, 321. The machining head 32, 321 is provided with support elements 48, 481 which are adapted to support two swivel gripping elements 50, 52; 501, 521. In particular, the two swivel gripping elements 50, 52; 501, 521 swivel between a position where their operating surface lies substantially parallel to the workpiece support bench, i.e. a position underneath the bottom edge of the disk where they are adapted to grip a slab or a part thereof; and a position substantially rotated through 90° where they are not operative and the cutting disk may perform machining of the slab. Advantageously, the two gripping elements can be swivelled in opposite directions.

The enlarged view shown in FIG. 7 shows in continuous lines the rest configuration and in broken lines the configuration where the gripping device is adapted to grip a slab.

This embodiment is particularly advantageous since the gripping devices are two in number and operated simultaneously so as to ensure a more balanced grip of the slab part to be moved.

In accordance with a possible embodiment of the present invention the workpiece support bench on which the slabs are placed is fixed, while the two cutting spindles are rotatable about their vertical axis.

The attached figures show various configurations of a machine according to the present invention.

For example, in FIG. 1, the two cutting disks are shown at the maximum possible distance from each other, are parallel to each other and are positioned in the longitudinal direction (parallel to the beam).

In FIG. 2, the two beams are moved as close together as possible with the two cutting disks facing each other and positioned in the longitudinal direction.

In FIG. 3, the two cutting disks are rotated through 90° compared to FIG. 1 and therefore are still parallel to each other, but arranged transversely (at right angles to the beam).

Figure 4:
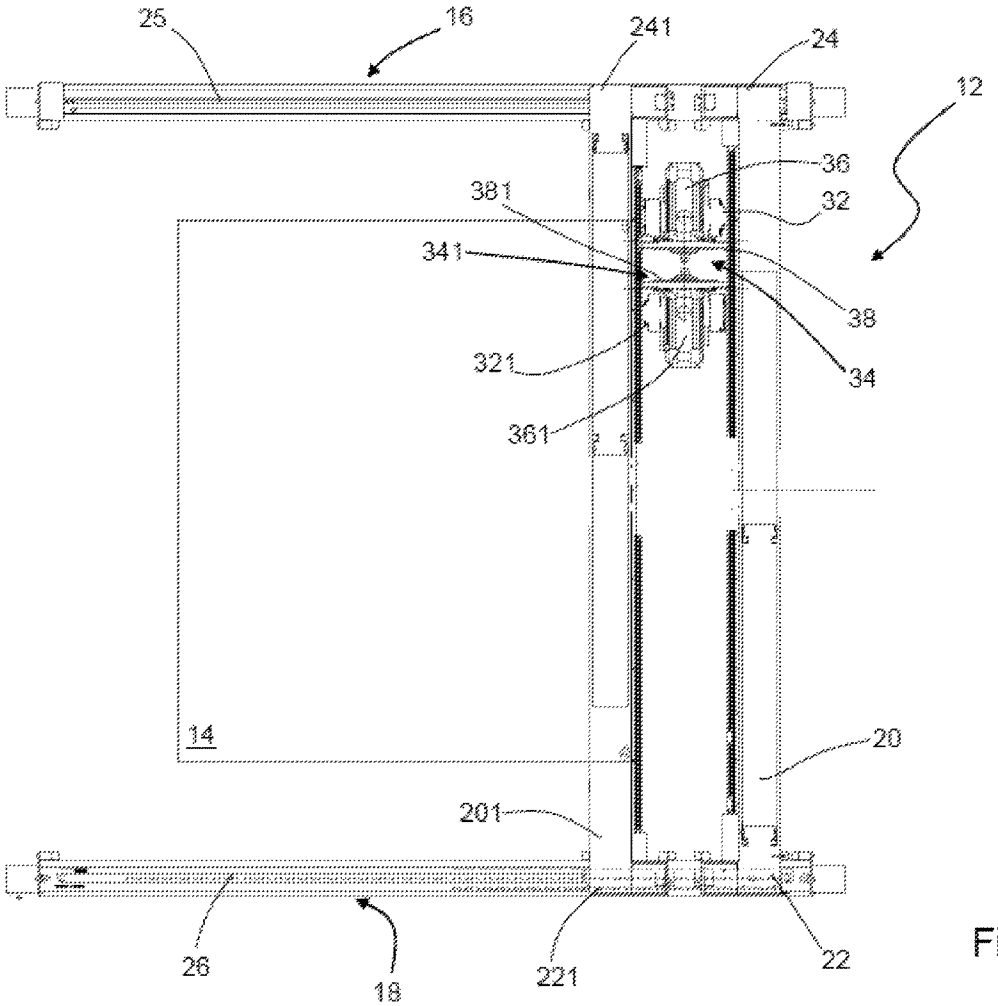
FIG. 4 shows in schematic form a top plan view of the machine according to FIG. 1, in a possible working configuration.
Figure 5:
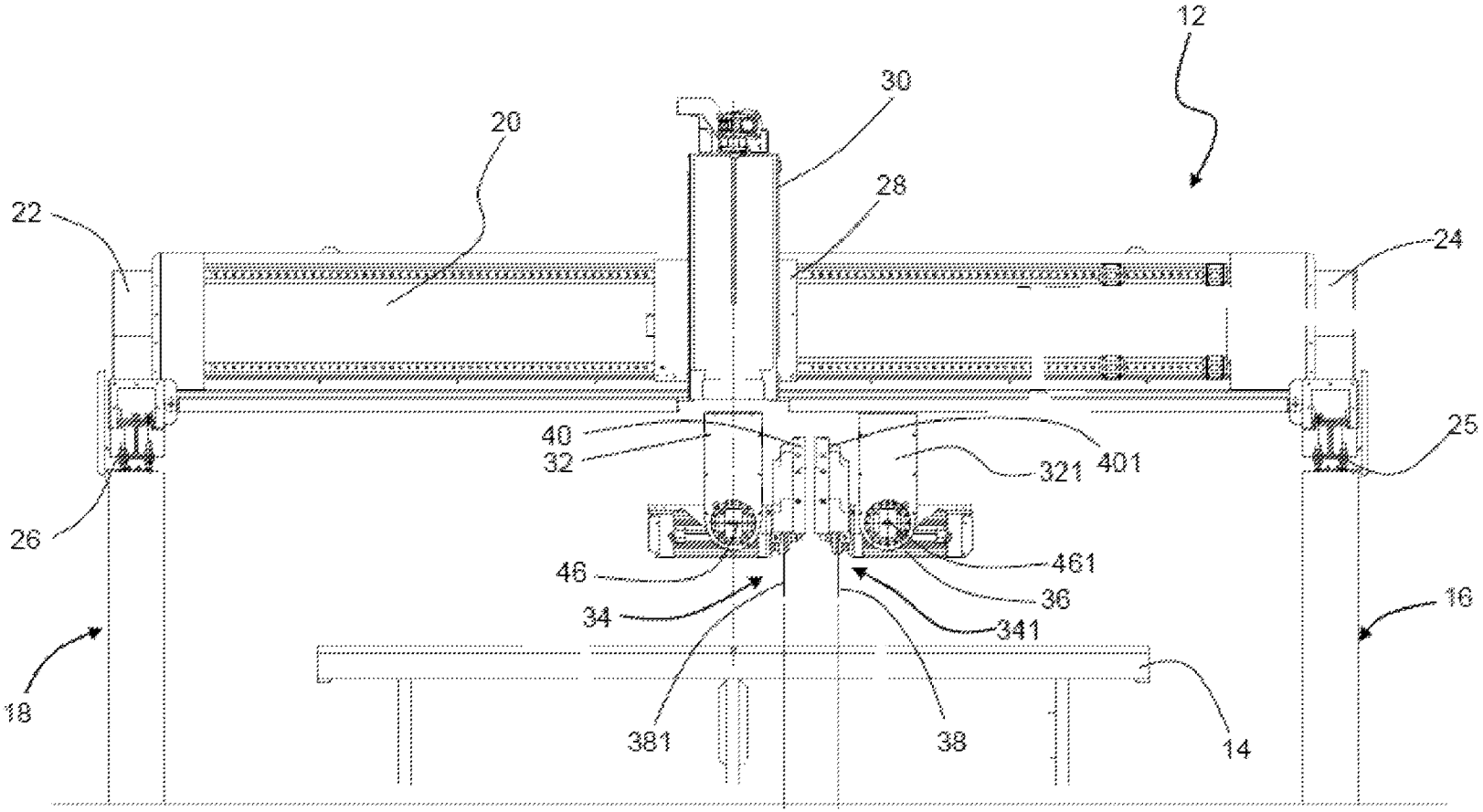
FIG. 5 shows a front view of the machine according to FIG. 4.

In FIGS. 4 and 5, the two beams have been moved as close together as possible with the two cutting disks facing each other and positioned in the transverse direction.

In order to be able to carry out as many cuts as possible using simultaneously both the spindles 34, 341, it is required to reduce the distance between the two spindles both in the direction transverse to the two beams and in the longitudinal direction of the beam.

In this connection it should be noted that according to a possible embodiment, the two cutting spindles 34 and 341 are mounted projecting both towards the inner side of the machine so that the minimum distance between the two cutting disks 38, 381 is the minimum possible with the facing disks arranged both longitudinally (FIG. 2, disks parallel to the beam) and transversely (FIG. 4, disks at right angles to the beam).

In particular, in FIG. 4 it can be noted that the two spindles 34, 341 may be rotated in opposite directions: one in one direction and the other in the opposite direction so that the two disks may be facing each other reducing the distance between them as far as possible.

Advantageously, both the sleeves 30, 301 are arranged on the inner side of the machine so as to face each other.

In order to optimize the cutting cycles, in the case where cuts parallel to each other must be performed (e.g. when it is required to cut the slab into strips), it is possible to operate with both the cutting disks 38, 381 positioned parallel to each other.

If parallel cuts must be performed in the transverse direction (at right angles to the beam 20, 201), owing to the fact that the two cutting disks 38, 381 may be positioned parallel to each other, but facing each other (see FIG. 4), it is possible to start the cut for both the disks 38, 381 at the same instant and terminate it again at the same instant, thus halving exactly the cutting time compared to that of a cut performed with a conventional machine.

Owing to these particular features, by operating using the two disks simultaneously, it is possible to perform the greatest number of cuts, using at the same time both the spindles 34, 341. Advantageously, the entire cutting operation for any slab may be performed using again the two spindles 34, 341 simultaneously.

Moreover, if both the heads are provided with sucker gripping means, not only the two cutting disks 38, 381 are able to cut simultaneously, but also the suckers of the two heads are adapted to work simultaneously.

The machine may be provided with a programmable control unit for managing the movement axes of the machine. The control unit may be adapted to implement an automatic program for optimizing cutting of a slab, depending on the form and dimensions of the slab to cut and the cuts to be performed. The control unit may therefore be adapted to define autonomously the cutting sequence of each spindle and the sequence for pick-up and displacement of the material by the at least one gripping device, in order to minimize the time required to cut the entire slab, avoiding any risk of collision between the moving parts.

In this way, the slab cutting times are practically halved compared to those of a conventional machines, using a machine having a cost which is only slightly higher than that of a conventional machine.

Figure 8:
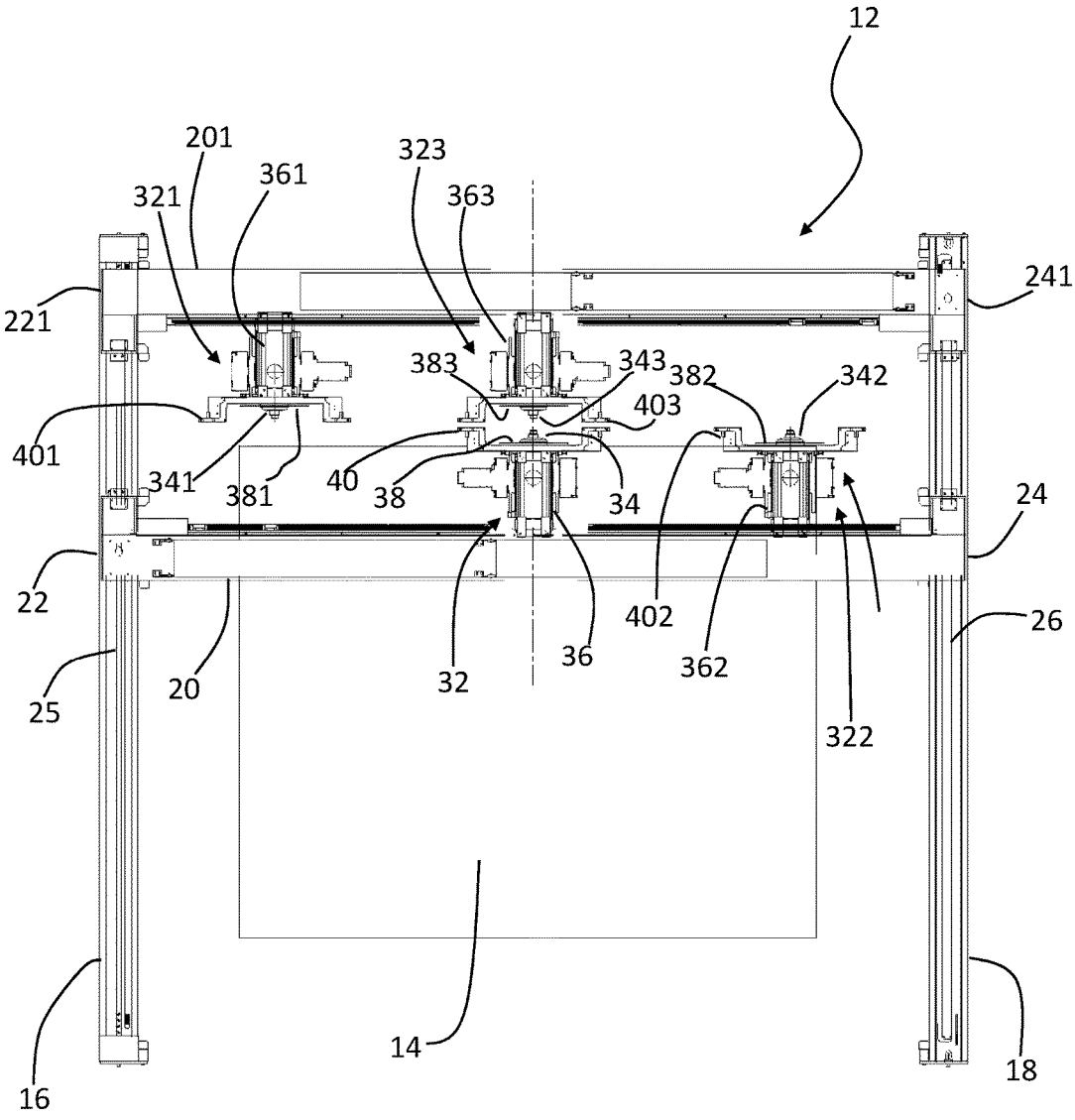
FIG. 8 shows in schematic form a top plan view of a machine according to the present invention in a possible working configuration.
Figure 9:
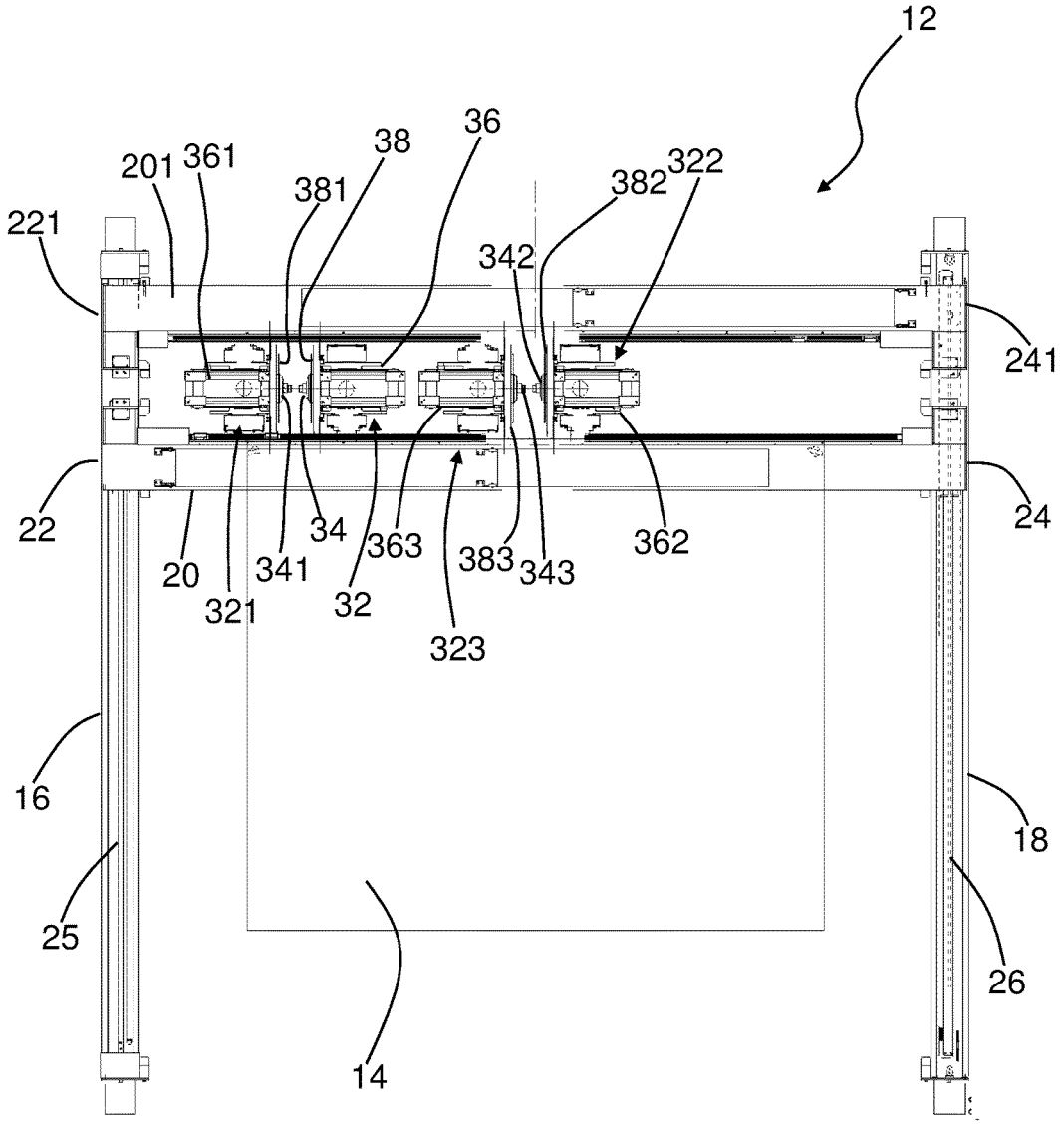
FIG. 9 shows in schematic form a top plan view of the machine according to FIG. 8, in a different working configuration.
Figure 10:
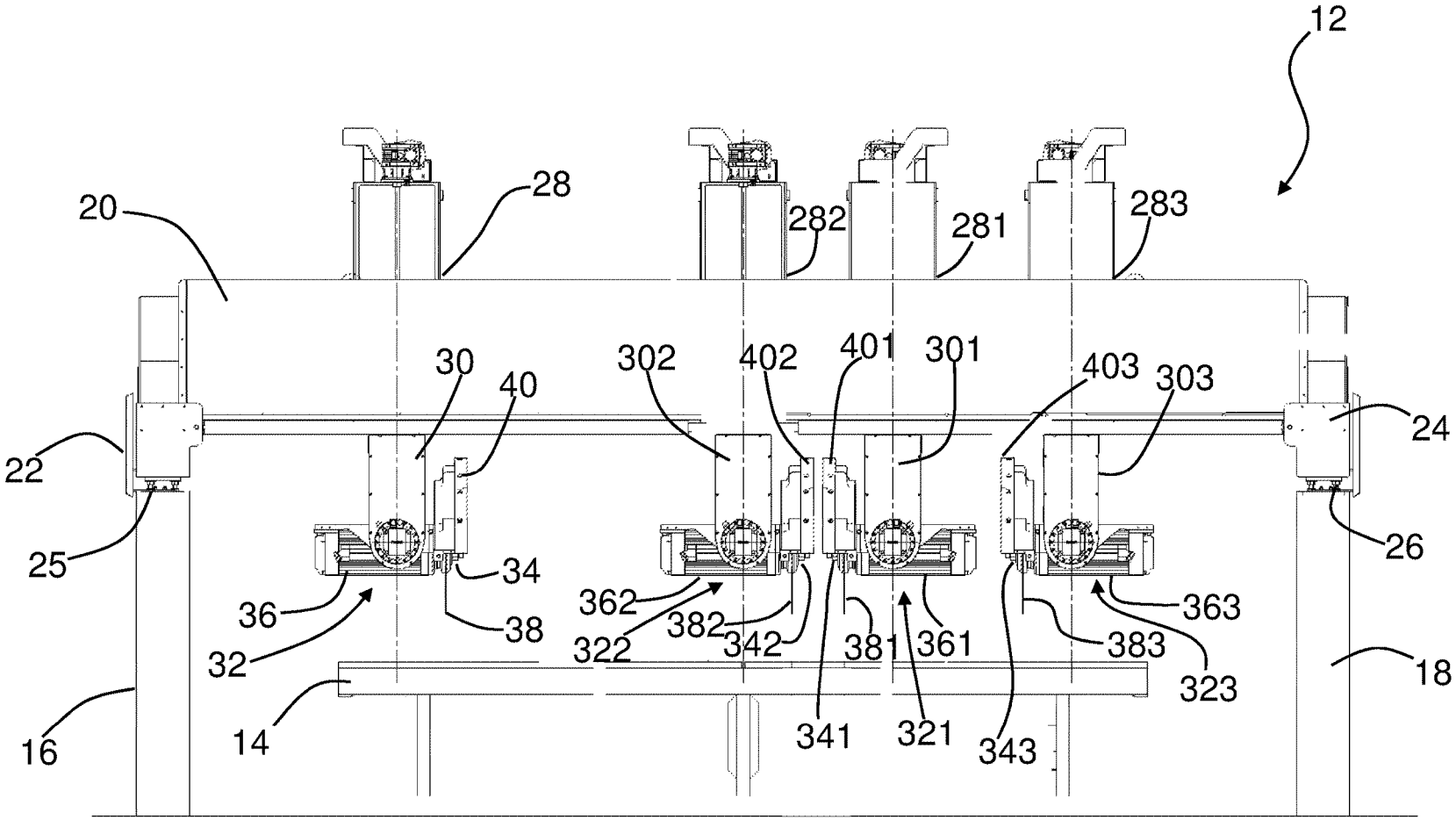
FIG. 10 shows in schematic form a side view of the machine according to FIG. 8, which simulates a possible working configuration.

FIGS. 8 to 10 show an alternative embodiment of the machine according to the present invention in which two machining units are provided on each beam 20, 201.

In particular, as can be seen from FIG. 8, at least two machining units each comprising a spindle 34, 342 suitable for mounting a cutting disk 380, 382 are arranged on the first beam 20.

The second beam 201 is provided with at least two machining units each comprising a spindle 341, 343 suitable for mounting a cutting disk 381, 383.

Each machining unit comprises a carriage 282; 281, 283 adapted to be moved along the respective beam 20, 201.

Since the movement of the carriage 28, 282; 281, 283 may be easily imagined by the person skilled in the art, it will not be described further.

Each carriage 28, 282; 281, 283 is provided with a sleeve 30, 302; 301, 303 adapted to be moved towards or away from the workpiece support bench 14.

Each sleeve 30, 302; 301, 303 is provided with a machining head 32, 322; 321, 323 comprising the respective cutting spindle 34, 342; 341, 343. The sleeve may comprise means for rotating the machining head 32, 322; 321, 323 about a substantially vertical axis of rotation.

The machining heads 32, 322; 321, 323 may comprise means for rotating the cutting spindles 34, 342; 341, 343 about an axis substantially parallel to the plane in which the workpiece support bench 14 lies. In this particular embodiment, it is possible to perform cuts inclined with respect to a direction substantially perpendicular to the plane in which the workpiece support bench lies.

Advantageously, each spindle 34, 342; 341, 343 is provided with its own electric motor 36, 362; 361, 363 for rotation of the respective cutting disk 38, 382; 381, 383.

Each spindle is provided with a protection element 40, 402; 401, 403.

At least one of the machining heads is provided with a gripping device 42, 422; 421, 423 for the slabs or parts thereof. In the preferred embodiment each machining head is provided with a gripping device for the slabs or parts thereof.

The gripping device may be provided directly on the head or may be provided on the protection element 40, 402; 401, 403.

In the preferred embodiment, the gripping device is provided on each protection element and may of the sucker type. The gripping device may comprise at least one sucker element which defines a closed space and is adapted to rest on a slab and prevent in the contact condition fluid from flowing between said closed space and the external environment.

A fluid connection with vacuum generating means is provided in said closed space of the sucker element.

In accordance with a possible embodiment of the present invention each sucker element may be activated in an independent manner.

The operating principle of the sucker-type gripping device was described above and will not further described.

According to alternative embodiments, the gripping device may be provided directly on the machining head so as to be slidable in a vertical direction, towards or away from the workpiece support bench 14. Advantageously in this case also, the gripping device may be of the sucker type.

The gripping device may also be of the swivel type and provided on the machining head. In particular, support elements adapted to support two swivel gripping elements may be provided on the machining head: the two swivel gripping heads swivel between a position where their operating surface lies substantially parallel to the workpiece support bench, and are therefore able to grip a slab or part thereof, and a position substantially rotated through 90° where they are not operative and the cutting disk may perform machining of the slab.

FIGS. 8 to 10 show various working configurations of the machine according to the present invention.

In FIG. 8 the machining units of the first beam 20 face the machining units of the second beam 201. In particular, the cutting disks are parallel to each other. In this configuration, the machine is adapted to perform simultaneously two—so-called longitudinal—cuts in two directions parallel to the beams; since the disks are aligned in pairs on each beam, they may perform simultaneously up to two single cuts, operating potentially in two different ways:

a single spindle of each beam is active, while the other one remains inactive positioned at one end of the beam.

both the spindles of each beam are active during the same cut, the first spindle cutting the slab over about half its thickness and the second spindle performing the cut in the residual thickness. By cutting half the thickness, the feeding speed of the two spindles is obviously doubled.

Longitudinal cuts consisting of a number greater than two are carried out by means of successive positioning of the beams.

In FIG. 9 the machining units are facing each other in pairs in a direction perpendicular to the beams. In this configuration it is possible to perform simultaneously four cuts parallel and spaced from each other.

In FIG. 10, the machining units are positioned so that the cutting disks are perpendicular to the direction of the beams and, in this configuration also, it is possible to perform cuts similar to those described above, with two spindles—one of the first beam and one of the second beam—along a same cutting path, in two directions perpendicular to the beams.

In this case also, the machine may be provided with a programmable control unit for managing the movement axes of the machine. The control unit may be adapted to implement an automatic program for optimizing cutting of a slab, namely define the cutting operations depending on the form and the dimensions of the slab to cut and those to be realized. Once the cutting operations have been defined, the control unit also determines the best cutting and pick-up sequence of each spindle and displacement of the material by at least one gripping device, in order to minimize the time for cutting of the entire slab, avoiding any risk of interference between the moving parts.

In this way, the slab cutting times are practically halved compared to those of a conventional machine, using a machine having a cost which is only slightly higher than the cost of a machine according to the prior art.

The advantages which can be achieved with a machine according to the present invention are therefore now clear the person skilled in the art.

It is possible to provide a machine which is able to obtain the advantages which could be achieved with the installation of a second machine.

Moreover, it is possible to increase substantially the production capacity of a machine of the type described above, but at the same time without increasing the costs thereof significantly.

Finally it is possible to provide a machine which is able to increase the production, while maintaining substantially unchanged the space occupied by the machine inside the production plant.

The person skilled in the art, in order to satisfy specific requirements, may make modifications to the embodiments described above and/or replace the parts described with equivalent parts, without thereby departing from the scope of the accompanying claims.

For example, in the present invention a machine with at least two beams has been described, but the principles of the present invention may comprise a greater number of beams, for example three beams.

Moreover, more than two machining units may be mounted on each beam.

The invention claimed is:

1. A machine for cutting slabs, comprising:

a workpiece support bench adapted to support at least one slab, and a cutting means for automated cutting of the at least one slab on the bench, wherein the cutting means further comprises:

two lateral support structures;

a first beam movable along said two lateral support structures, said first beam being slideable on the two lateral support structures and a guiding means provided on the two lateral support structures, said first beam being provided with a machining unit comprising a first carriage movable along the first beam, a first sleeve movable toward or away from the workpiece support bench being provided on said first carriage, and a first machining head comprising a first cutting spindle being provided on said first sleeve; and a second beam provided with a machining unit comprising a second carriage movable along the second beam, a second sleeve adapted to be moved towards or away from the workpiece support bench being provided on said second carriage, and a second machining head comprising a second cutting spindle being provided on said second sleeve;

wherein at least one of the first machining head and the second machining head is provided with a gripping device for gripping the at least one slab or parts of the slab;

wherein said second beam and machining unit is movable along said two lateral support structures independently of the first beam and slidable on the two lateral support structures.

2. The machine according to claim 1, characterized in that the second beam is slidable on the guiding means of the lateral supports.

3. The machine according to claim 1, characterized in that at least one of the first cutting spindle and second cutting spindle is provided with a protection element provided with the gripping device.

4. The machine according to claim 1, characterized in that both the first cutting spindle and the second cutting spindle are provided with a protection element provided with the gripping device.

5. The machine according to claim 1, characterized in that the gripping device is provided on the at least one of the first machining head and the second machining head and is slidable in a vertical direction toward or away from the workpiece support bench.

6. The machine according to claim 1, characterized in that the gripping device is provided on the at least one of the first machining head and the second machining head and comprises support elements adapted to support two swivel gripping elements which swivel in two opposite directions.

7. The machine according to claim 6, characterized in that said swivel gripping elements are adapted to rotate between a first position in which an operating surface thereof lies substantially parallel to the workpiece support bench and a position substantially rotated 90° from the first position in which the swivel gripping elements are not operative whereby a cutting disk is positionable to perform machining of the slab.

8. The machine according to claim 1, characterized in that the gripping device is of a type comprising a sucker.

9. The machine according to claim 1, characterized in that at least one of the first machining head and the second machining head comprises means for rotation of the first and second cutting spindles about an axis substantially parallel to a plane in which the workpiece support bench lies.

10. The machine according to claim 1, characterized in that the first and second cutting spindles are rotatable about a vertical axis.

11. The machine according to claim 1, characterized in that the workpiece support bench is rotatable.

12. The machine according to claim 1, characterized in that the first and second cutting spindles are mounted on respective of the first and second beams and each project toward an inside of the machine.

13. The machine according to claim 1, characterized in that both of the first and second sleeves are arranged on an inner side of the machine, so as to face each other.

14. The machine according to claim 1, characterized in that each of the first and second beams comprises two machining units each comprising a spindle adapted to mount a cutting disk.

15. The machine according to claim 1, further comprising a programmable control unit adapted to manage movement axes of the machine and adapted to manage a simultaneous movement of the first and second spindles and the gripping device.

* * * * *